US007967469B2

(12) United States Patent
Fang et al.

(10) Patent No.: US 7,967,469 B2
(45) Date of Patent: Jun. 28, 2011

(54) LED LAMP

(75) Inventors: Hai-Ming Fang, Shenzhen (CN); Yong-Dong Chen, Shenzhen (CN); Shih-Hsun Wung, Taipei Hsien (TW)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 244 days.

(21) Appl. No.: 12/432,742

(22) Filed: Apr. 29, 2009

(65) Prior Publication Data

US 2010/0110683 A1 May 6, 2010

(30) Foreign Application Priority Data

Oct. 30, 2008 (CN) ..... 2008 1 0305304

(51) Int. Cl.
*F21S 4/00* (2006.01)
*F21V 21/00* (2006.01)

(52) U.S. Cl. ..... 362/249.02; 362/311.02; 362/374; 362/800

(58) Field of Classification Search ..... 362/217.14–217.16, 218, 249.02, 362/311.02, 373–375, 800
See application file for complete search history.

(56) References Cited

U.S. PATENT DOCUMENTS 7,766,510 B2 * 8/2010 Lee ..... 362/249.02

* cited by examiner

*Primary Examiner* — Jason Moon Han
(74) *Attorney, Agent, or Firm* — Frank R. Niranjan

(57) ABSTRACT

An LED lamp includes a heat sink having a planar base, a plurality of LED modules attached to a bottom face of the base, an envelope disposed on the bottom face of the base and covering the LED modules, and a lamp bracket securing the base and the envelope together. The lamp bracket includes a vertical frame which defines an opening at a lateral side thereof, an engaging flange extending from an inner face of the frame and supporting a fixing flange of the envelope, and a plurality of protrusions projecting from the inner face of the frame above the engaging flange and pressing the base downwardly towards the envelope. The base of the heat sink and the envelope are inserted into the vertical frame through the opening.

14 Claims, 4 Drawing Sheets

LED LAMP

BACKGROUND

1. Technical Field

The present disclosure relates to LED (light emitting diode) lamps and, more particularly, to an LED lamp having enhanced waterproofing.

2. Description of Related Art

LEDs are well known solid state light sources, in which current in a forward direction at a junction, comprising two different semiconductors, electrons and cavities generate light. LEDs provide advantages of resistance to shock and practically limitless lifetime under specific conditions. When deployed in a lamp, LEDs offer a cost-effective yet high quality alternative to incandescent and fluorescent fixtures.

An LED lamp generally requires a plurality of LEDs mostly driven at the same time, which results in a rapid rise in operating temperature of the LEDs. However, since the lamps lack effective heat dissipation capability, continuous operation of the LEDs can cause instability in light emitted from the LEDs. Consequently, the LED lamp usually comprises a heat sink contacting the LEDs to dissipate the heat generated thereby. When the LED lamp is used outdoors for illumination, dust and moisture may enter the LED lamp, causing current leakage or short circuit, or other contamination of the LEDs. A conventional waterproof structure of an LED lamp includes a waterproof gasket and a groove defined in an envelope which correspondingly covers the LEDs. The envelope is disposed on the heat sink. The waterproof gasket received in the groove is sandwiched between the envelope and the heat sink. However, this conventional structure requires multiple through holes defined in the envelope for multiple screws respectively extending through the envelope and screwing into the heat sink. For the envelope generally made from specific transparent materials, such as glass, the work in forming the through holes in the envelope is relatively difficult and may result in a high defect rate of products. In addition, rainwater can creep through the holes of the envelope to enter an inside of the LED lamp. Thus, such engagement of the envelope to the heat sink by extending screws through the envelope has drawbacks.

What is needed, therefore, is an improved LED lamp which can overcome the described disadvantages.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION

Figure 1:
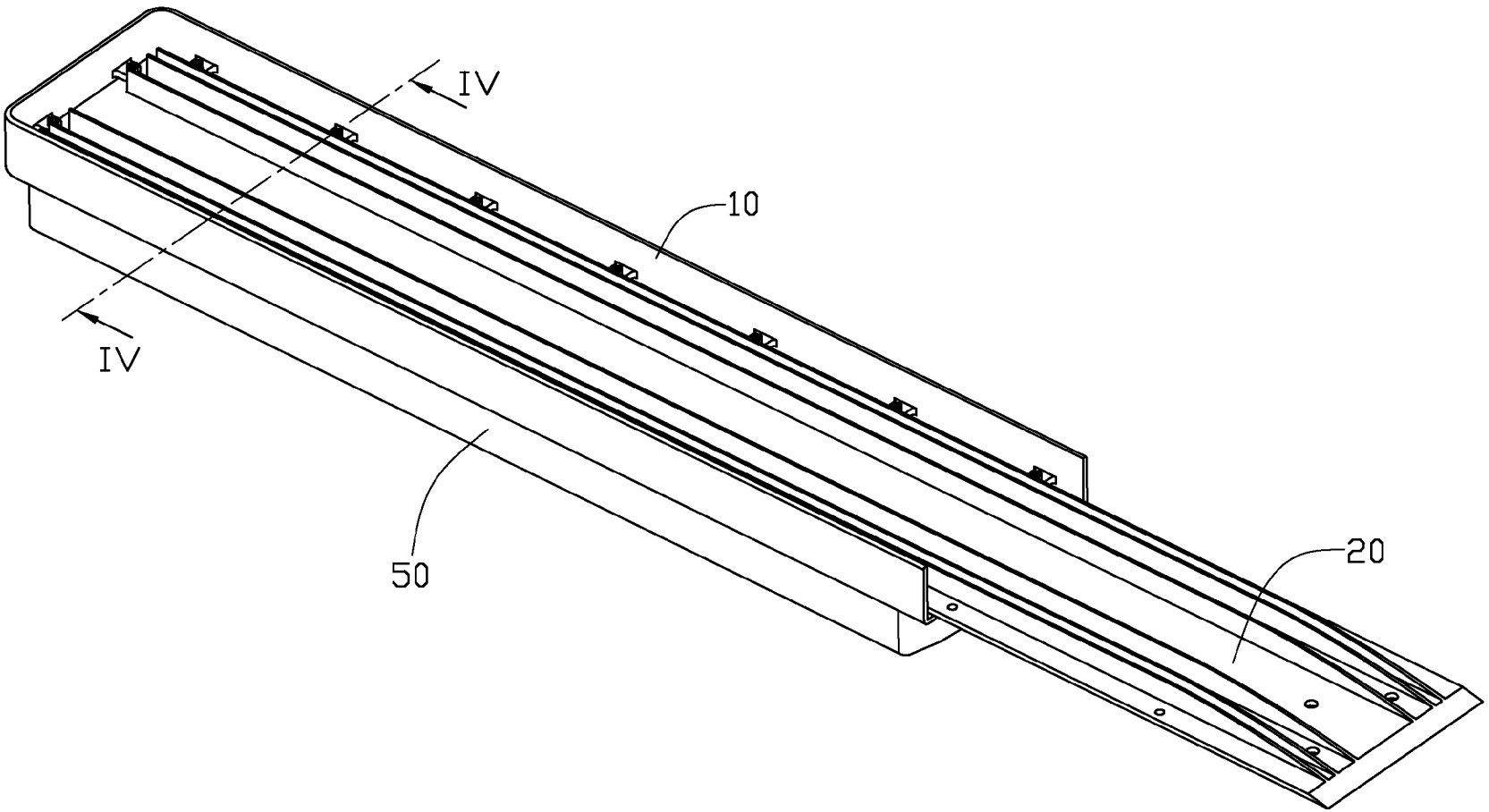
FIG. 1 is an isometric, assembled view of an LED lamp in accordance with the disclosure.
Figure 2:
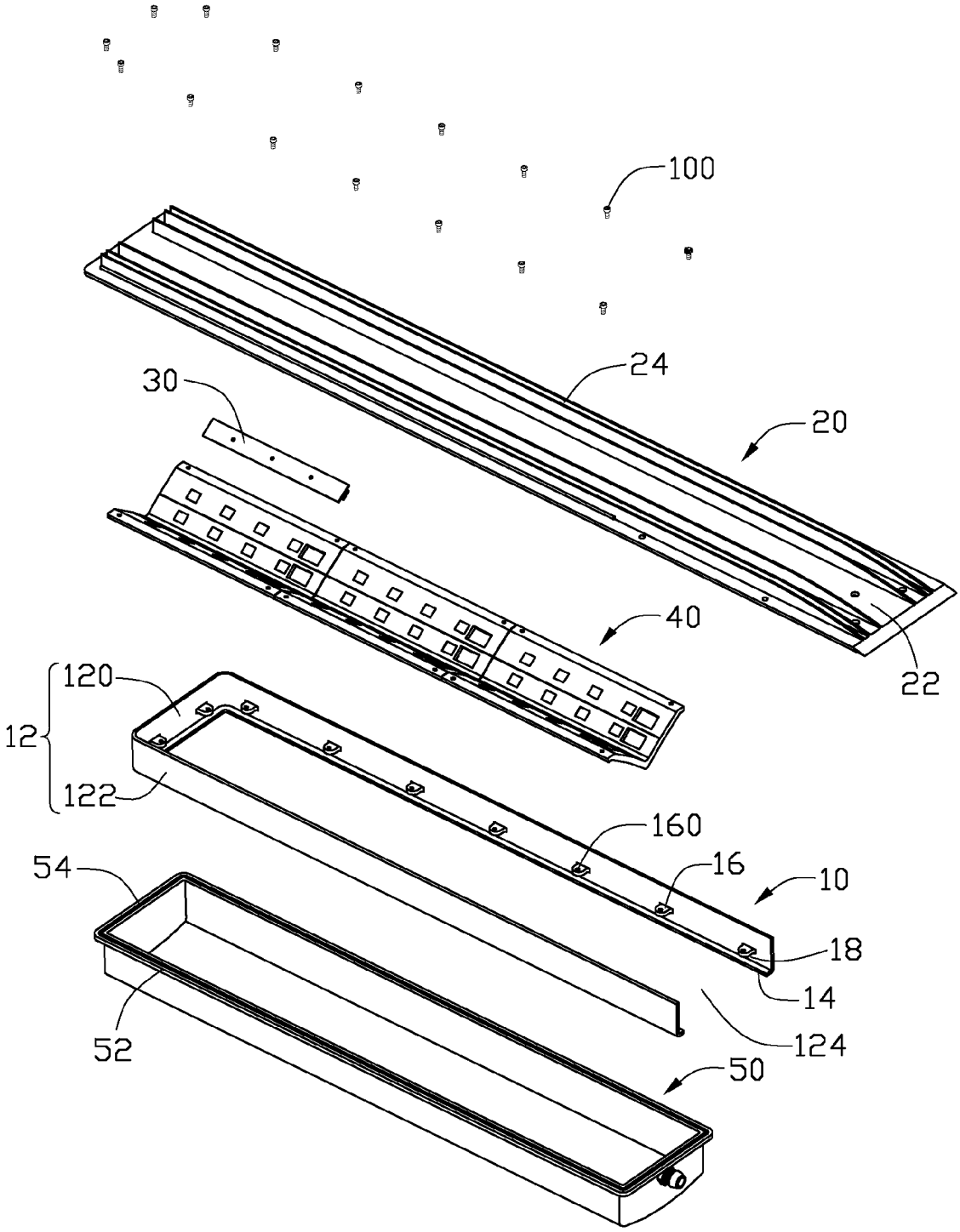
FIG. 2 is an exploded view of the LED lamp in FIG. 1.

Referring to FIGS. 1-2, an LED lamp in accordance with the disclosure is illustrated. The LED lamp comprises a lamp bracket 10, a heat sink 20, a plurality of LED modules 30 attached on a bottom of the heat sink 20, a light-guiding board 40 mounted on the bottom of the heat sink 20 and covering the LED modules 30, and an envelope 50 disposed on the bottom of the heat sink 20 and covering the LED modules 30 and the light-guiding board 40. The lamp bracket 10 secures the envelope 50 to the heat sink 20.

Figure 3:
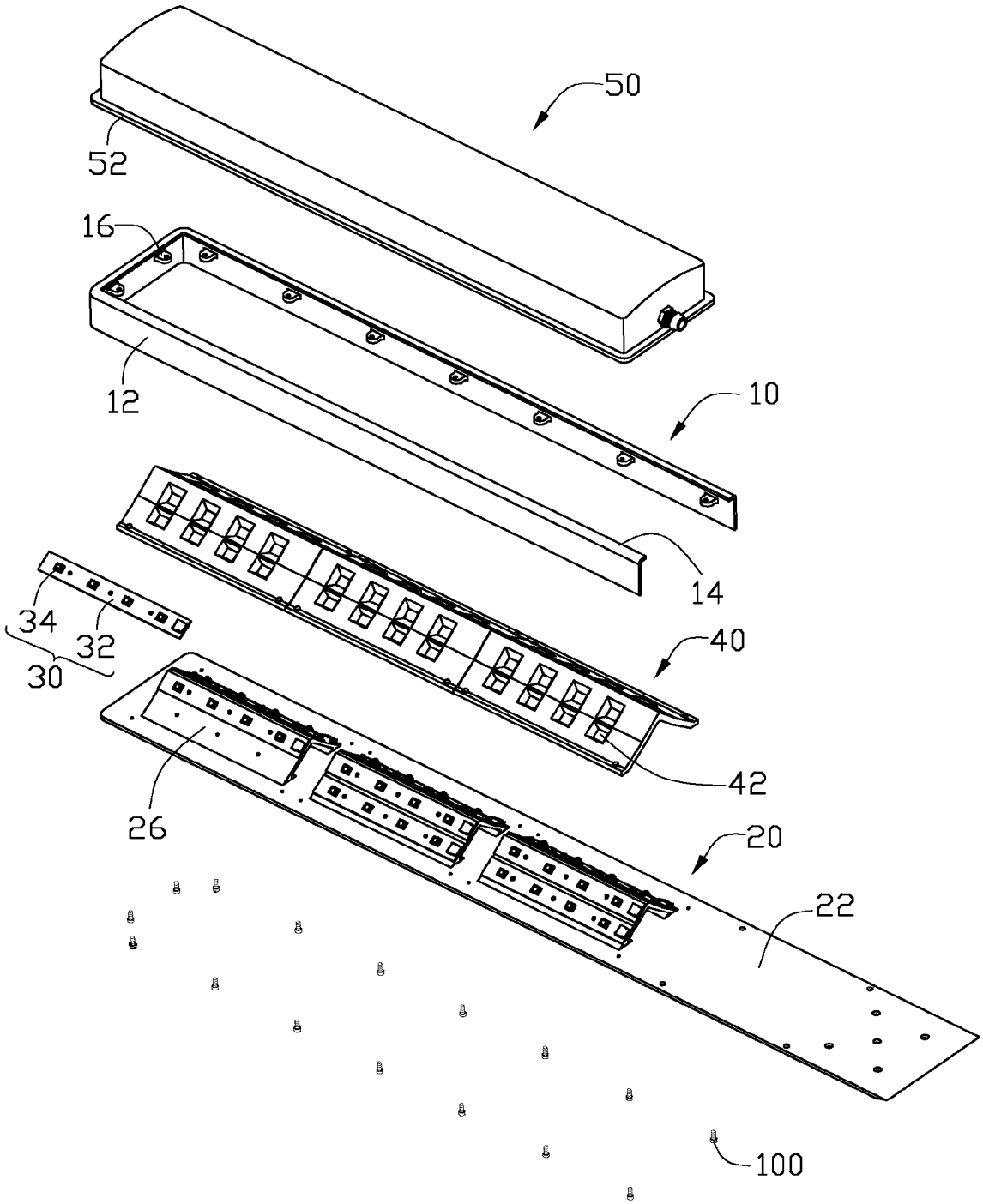
FIG. 3 is an inverted, exploded view of the LED lamp in FIG. 1.

Also referring to FIG. 3, the lamp bracket 10 is integrally made of a metal with high heat conductivity, such as copper, aluminum, or an alloy thereof. The lamp bracket 10 comprises a U-shaped frame 12 and a plurality of protrusions 16 extending inwardly from an inner face of the frame 12. The frame 12 comprises a vertical section 120 and two vertical arms 122 extending horizontally and perpendicularly from two opposite lateral sides of the vertical section 120, respectively. An opening 124 is defined between free ends of the two vertical arms 122 and opposite to the vertical section 120. The vertical section 120 and the vertical arms 122 are all rectangular. An engaging flange 14 extends inwardly and horizontally from a bottom end of the frame 12. The protrusions 16 are coplanar with each other and parallel to the engaging flange 14. In other words, the protrusions 16 cooperatively define a plane (not labeled) which is parallel to the engaging flange 14. Thus, the protrusions 16 cooperate with the engaging flange 14 to define a continuous channel 18 therebetween. Each of the protrusions 16 defines a through hole 160 at a central portion thereof. In this embodiment, two spaced protrusions 16 project perpendicularly from an inner face of the vertical section 120 of the frame 12, and seven spaced protrusions 16 project perpendicularly and evenly from an inner face of each vertical arm 122 of the frame 12.

The heat sink 20 is integrally made of a metal with high heat conductivity, such as copper, aluminum, or an alloy thereof. The heat sink 20 comprises an elongated base 22, a plurality of spaced fins 24 extending upwardly from a top face of the base 22 and a plurality of spaced fixing brackets 26, to which the LED modules 30 are respectively attached, extending downwardly from a bottom face of the base 22. The base 22 is a rectangular plate. A width of the base 22 is substantially the same as that of the vertical section 120 of the frame 12, and a thickness of the base 22 is less than a distance between the protrusion 16 and the engaging flange 14. The base 22 is longer than the lamp bracket 10 so that an end of the base 22 would extend beyond the bracket 10, when the heat sink 20 is assembled on the lamp bracket 10. Each of the fixing brackets 26 comprises two rectangular plates (not labeled) extending from the bottom face of the base 22 inclinedly and towards each other, whereby a cross-section of the fixing bracket 26 is V-shaped. The two plates of each fixing bracket 26 and the base 22 cooperatively define a triangle space (not labeled) therebetween. The fixing brackets 26 are in alignment with each other and extend in a lengthwise direction of the base 22.

Each of the LED modules 30 comprises a printed circuit board 32 having a rectangular shape, and a plurality of LEDs 34 mounted on the printed circuit board 32 and arranged evenly in a lengthwise direction of the printed circuit board 32. The LED modules 30 are thermally fixed on outer faces of the plates of the fixing brackets 26, respectively.

The light-guiding board 40 has a configuration corresponding to that of the fixing bracket 26 of the heat sink 20, whereby the light-guiding board 40 can be correspondingly fixed on the fixing bracket 26 of the heat sink 20 and cover the LED modules 30 mounted thereon. The light-guiding board 40 defines a plurality of tapered cavities 42 in which the LEDs 34 of the LED modules 30 are received, whereby when the LEDs 34 are activated, a part of light emitted from the LEDs 34 is able to emit to outside directly, and remaining part of the light is reflected by inner faces of the cavities 42; thus, a high-intensity illumination is obtained.

The envelope 50 has a cuboid configuration and defines a cavity (not labeled) in a top face thereof. An annular fixing flange 52 extends outwardly and horizontally from a circumference of a top end of the envelope 50. An annular groove (not labeled) is defined in a top face of the fixing flange 52 for receiving a waterproof gasket 54 therein. The waterproof gasket 54 abuts against the bottom face of the base 22 to thereby hermetically seal the cavity of the envelope 50. The envelope 50 is made of transparent material such as plastic, glass, or other suitable material availing to transmit light.

Figure 4:
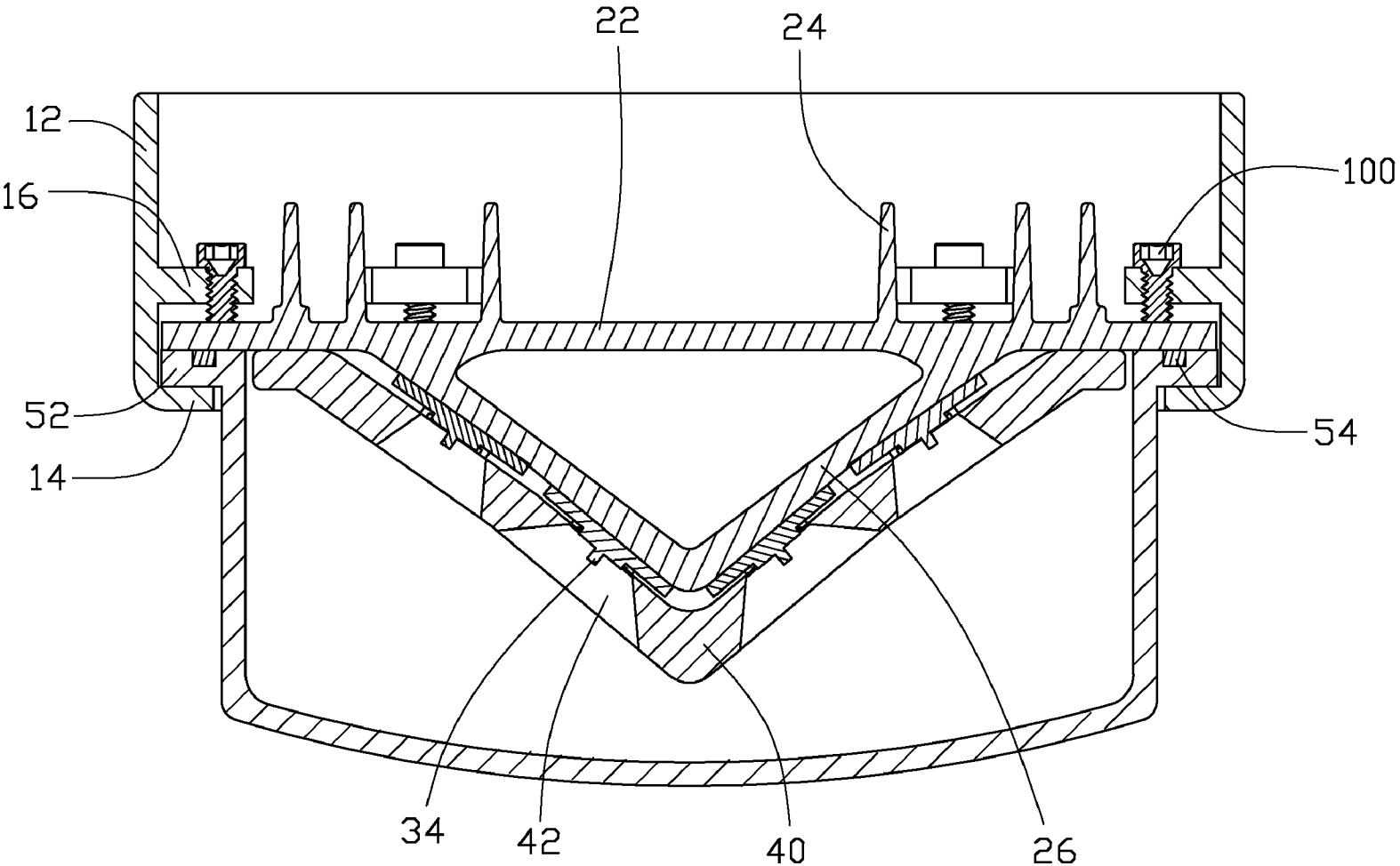
FIG. 4 is a cross-section of the LED lamp of FIG. 1, taken along a line IV-IV thereof.

Referring to FIG. 4 also, in assembly of the LED lamp, the LED modules 30 are thermally mounted on the fixing brackets 26 of the heat sink 20 whereby the light emitted from the LEDs 34 radiates downwardly towards two opposite sides of the LED lamp. The light-guiding board 40 is fixed on the bottom of the base 22 and covers the LED modules 30. The envelope 50 is disposed on the bottom of the base 22 and cooperates with the base 22 to accommodate the LED modules 30 and the light-guiding board 40 therein. The base 22, together with the envelope 50, extends through the opening 124 of the frame 12, along the channel 18, to the vertical section 120. The fixing flange 52 of the envelope 50 and a circumference of the base 22 are stacked up and sandwiched between the protrusions 16 and the engaging flange 14 of the lamp bracket 10. To reliably secure the envelope 50 to the heat sink 20, a number of screws 100 engagingly extend through the through holes 160 of the protrusions 16, abutting against the top face of the base 22 and urging the base 22 towards the envelope 50. Since the envelope 50 is fixed to the heat sink 20 by sandwiching the fixing flange 52 of the envelope 50 and the base 22 in the bracket 10, it is not required to form through holes in the envelope 50; thus, the waterproof effectiveness of the LED lamp can be enhanced according to the present disclosure.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An LED (light emitting diode) lamp comprising:

a heat sink having an elongated base;

a plurality of LED modules attached to a bottom of the base of the heat sink;

an envelope disposed on the bottom of the base and covering the LED modules, the envelope having a fixing flange extending outwardly from a top of the envelope; and a lamp bracket securing the envelope and the heat sink together, the lamp bracket defining a channel to receive a circumference of the base and the fixing flange of the envelope therein, wherein the lamp bracket comprises a frame surrounding the base and the envelope, an engaging flange extending from a bottom of the frame and supporting the fixing flange of the envelope, and a plurality of protrusions projecting from the frame close to the engaging flange and pressing the base downwardly towards the envelope, and wherein the frame is U-shaped and comprises a rectangular vertical section and two vertical arms extending horizontally from two opposite lateral sides of the vertical section, respectively.

2. The LED lamp as claimed in claim 1, wherein the channel is cooperatively defined by and between the protrusions and the engaging flange.

3. The LED lamp as claimed in claim 1, wherein the protrusions and the engaging flange are parallel to each other and perpendicular to the frame.

4. The LED lamp as claimed in claim 1, wherein the protrusions are coplanar with and spaced from each other.

5. The LED lamp as claimed in claim 1, wherein the frame defines an opening between ends of the two vertical arms, and the heat sink and the envelope are inserted into the frame of the lamp bracket through the opening and along the channel.

6. The LED lamp as claimed in claim 1, wherein each of the protrusions defines a through hole at a central portion thereof for a screw engagingly extending therethrough, the screws pressing the base against the envelope.

7. The LED lamp as claimed in claim 1 further comprising a light-guiding board, wherein the light guiding board is fixed on the bottom of the base and correspondingly disposed on the LED modules for guiding light emitted by the LED modules.

8. The LED lamp as claimed in claim 1, wherein a plurality of spaced fins extends perpendicularly from a top face of the base.

9. An LED (light emitting diode) lamp comprising:

a heat sink comprising a planar base and a plurality of fins extending upwardly from a top face of the base;

a plurality of LED modules attached to a bottom face of the base;

an envelope disposed on the bottom face of the base and covering the LED modules; and a lamp bracket comprising a vertical frame which defines an opening at a lateral side thereof, an engaging flange extending from an inner face of the frame and supporting the envelope, and a plurality of protrusions projecting from the inner face of the frame above the engaging flange and pressing the base downwardly towards the envelope, the base and the envelope inserted into the frame through the opening, wherein the frame is U-shaped and comprises a rectangular vertical section and two vertical arms extending horizontally from two opposite lateral sides of the vertical section, respectively.

10. The LED lamp as claimed in claim 9, wherein a fixing flange extends outwardly from an outer circumference of the envelope.

11. The LED lamp as claimed in claim 10, wherein the fixing flange and the circumference of the base are sandwiched between the protrusions and the engaging flange.

12. The LED lamp as claimed in claim 9, wherein the protrusions and the engaging flange are perpendicular to the frame.

13. The LED lamp as claimed in claim 9, wherein a plurality of screws extend through the protrusions and abut against the top face of the base to press the top face of the base toward the envelope.

14. The LED lamp as claimed in claim 9, wherein a plurality of fixing brackets are formed on the bottom face of the base to which the LED modules are attached, and each of the fixing brackets comprises two plates extending from the base inclinedly and towards each other, whereby each fixing bracket has a V-shaped cross-section, and the LED modules are respectively attached to outer faces of the plates.

* * * * *